US005081814A

United States Patent [19]

Singletary et al.

[11] Patent Number: 5,081,814

[45] Date of Patent: Jan. 21, 1992

[54] LATH PANEL AND METHOD OF MANUFACTURE

[75] Inventors: David B. Singletary, Morris; Larry W. Malone, Hueytown, both of Ala.

[73] Assignee: Alabama Metal Industries, Birmingham, Ala.

[21] Appl. No.: 601,894

[22] Filed: Oct. 22, 1990

[51] Int. Cl.[5] ..... E04C 2/42; E04C 5/07

[52] U.S. Cl. ..... 52/670; 52/672; 52/676

[58] Field of Search ..... 52/670, 671, 672, 676, 52/507, 816, 817, 818

[56] References Cited

U.S. PATENT DOCUMENTS

| | | | |
|---|---|---|---|
| 1,128,659 | 2/1915 | Clark | 52/672 |
| 1,314,777 | 9/1919 | White | 52/672 |
| 4,734,337 | 3/1988 | Patton | 52/672 |

FOREIGN PATENT DOCUMENTS

| | | | |
|---|---|---|---|
| 2300690 | 7/1974 | Fed. Rep. of Germany | 52/672 |

*Primary Examiner*—David A. Scherbel
*Assistant Examiner*—Kien Nguyen
*Attorney, Agent, or Firm*—Jennings, Carter, Thompson & Veal

[57] ABSTRACT

A reinforced lath panel typically mounted to a vertical frame on which plaster or other plastics can be supported in a structural unit and includes at least one marginal rib having a plurality of interconnected layers and a rounded outer edge with a mesh mounted to the marginal ribs and having a plurality of interconnected strands. The present invention provides a novel method for manufacturing the aforesaid lath panel wherein the marginal ribs are formed concurrently with the formation of the strands, wherein a punch press commonly used to form the strands is fitted with forming surfaces which progressively bend and fold at least one lateral edge of the lath panel to form at least one marginal rib in sequence with the formation of the strands.

6 Claims, 5 Drawing Sheets

FIG. 13
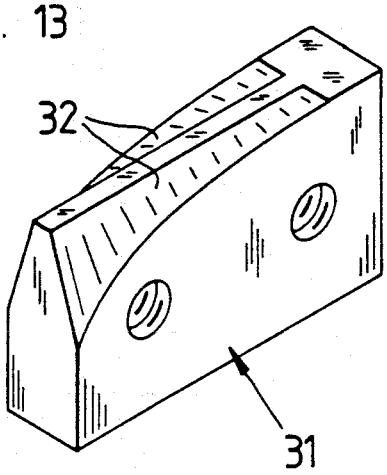
FIG. 9
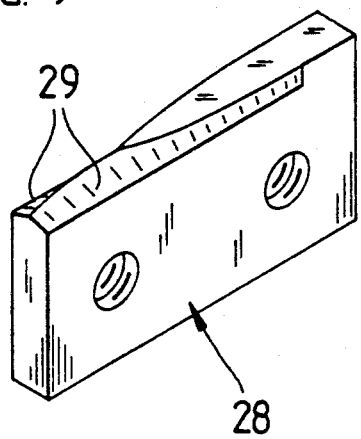
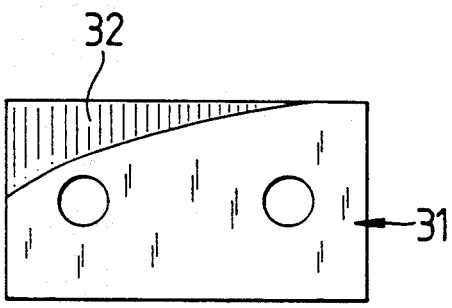
FIG. 14
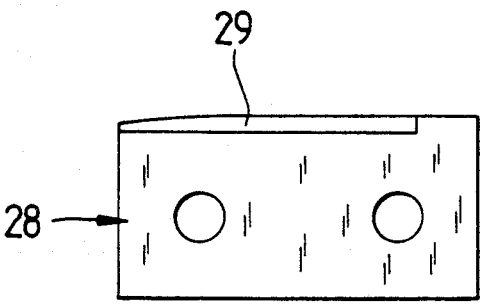
FIG. 10
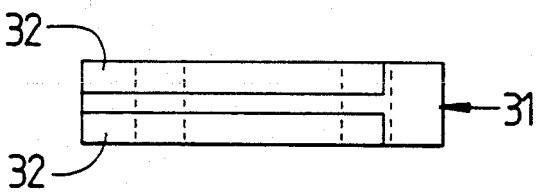
FIG. 15
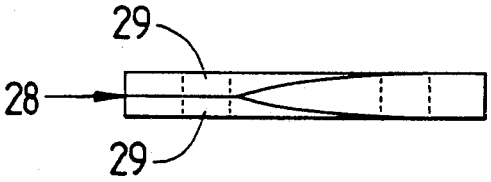
FIG. 11
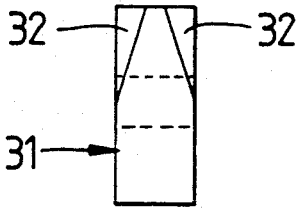
FIG. 16
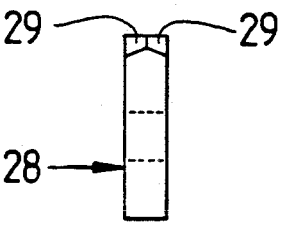
FIG. 12

LATH PANEL AND METHOD OF MANUFACTURE

FIELD OF THE INVENTION

The present invention relates to panels for supporting plaster or other plastics on a frame and more particularly to panels of metal mesh reinforced by ribs. In greater particularity, the present invention relates to expanded metal lath panels or any steel sheet panels having marginal ribs formed from a plurality of interconnected layers. In even greater particularity, the present invention relates to expanded metal lath panels having marginal ribs with smooth outer edges and methods for manufacturing such marginal ribs.

BACKGROUND OF THE INVENTION

Expanded metal lath panels are commonly used in the construction industry as a means for supporting plaster or other plastics of high viscosity on a vertical, inclined or horizontal frame. Prior lath panels have varied in construction from a simple wire net to an expanded metal mesh of rigid horizontal surfaces reinforced by a plurality of ribs. The plaster is applied to the mesh which supports the same as a structural unit.

Some improvements have been made in the configuration of such ribs usually limited to certain angular configurations primarily designed to facilitate interlocking the marginal ribs of two adjacent panels and achieving maximum resistance to deflection.

These ribs, though having a variety of lateral diameters and angular configurations, are only as thick as the blank metal sheet stock from which the lath panel was constructed, being the same thickness as any other of the lath panel's components. Though intended for reinforcement, these prior rib configurations have been limited in their success for the aforesaid reason that their thickness is no greater than the panel they were designed to reinforce.

The marginal ribs, being the lateral margin of a thin sheet of metal used to form the lath panels, have sharp edges which commonly can damage the hands and clothing of the worker handling such panels. These thin outer edges are also easily damaged during transport.

SUMMARY OF THE INVENTION

It is the principal object of the present invention to provide an improved lath panel which is more rigid than conventional lath panels.

In support of the principal object, another object of the present invention is to provide improved lath panels which concentrate more reinforcement at the overlapping joints of two adjacent panels to improve the integrity of plaster placed thereon.

Another object of the present invention is to provide a lath panel having smooth rounded edges for safer handling.

Yet another object of the present invention is to provide an improved lath panel which is less susceptible to damage than conventional lath panels.

These and other objects and advantages of our invention are accomplished through the use of at least one marginal rib integrally connected to the margin of a metal mesh which forms the dominant area of the lath panel. Each marginal rib is bent about its longitudinal axis in overlapping planar abutment with itself having a rounded outer edge co-extensive with the line of bending.

BRIEF DESCRIPTION OF THE DRAWINGS

Apparatus embodying features of my invention are depicted in the accompanying drawings which form a portion of this disclosure and wherein:

FIG. 9 is a perspective view of a first embodiment of a edge forming tool;

FIG. 10 is a side elevational view of the edge forming tool of FIG. 9;

FIG. 11 is a top plan view of the edge forming tool of FIG. 9;

FIG. 12 is an end elevational view of the edge forming tool of FIG. 9;

FIG. 13 is a perspective view of a second embodiment of an edge forming tool;

FIG. 14 is a side elevational view of the edge forming tool of FIG. 13;

FIG. 15 is a top plan view of the edge forming tool of FIG. 13; and

FIG. 16 is an end elevational view of the edge forming tool of FIG. 13.

DESCRIPTION OF A PREFERRED EMBODIMENT

Figure 2:
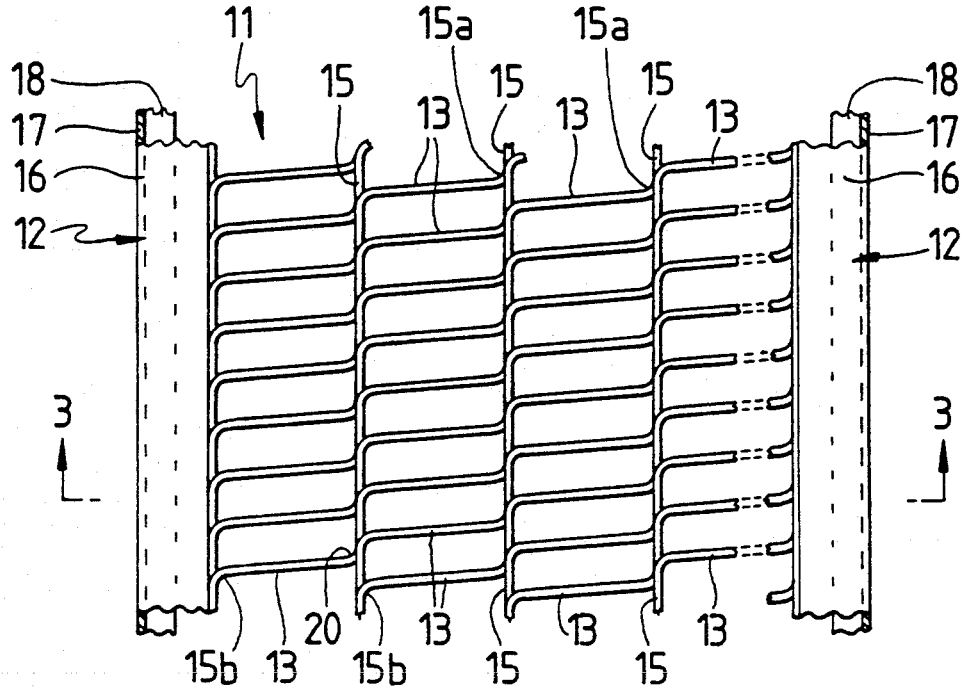
FIG. 2 is a front elevational view thereof.
Figure 3:
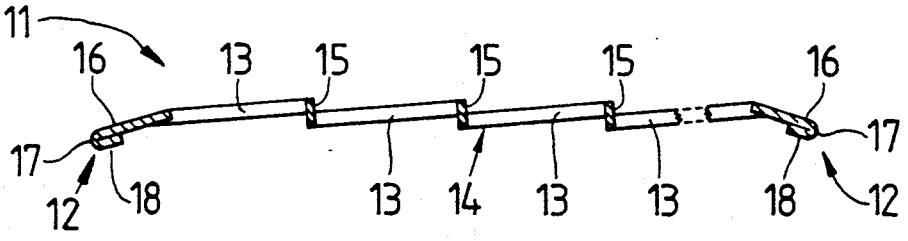
FIG. 3 is a sectional view taken along line 3—3 of FIG. 2.
Figure 1:
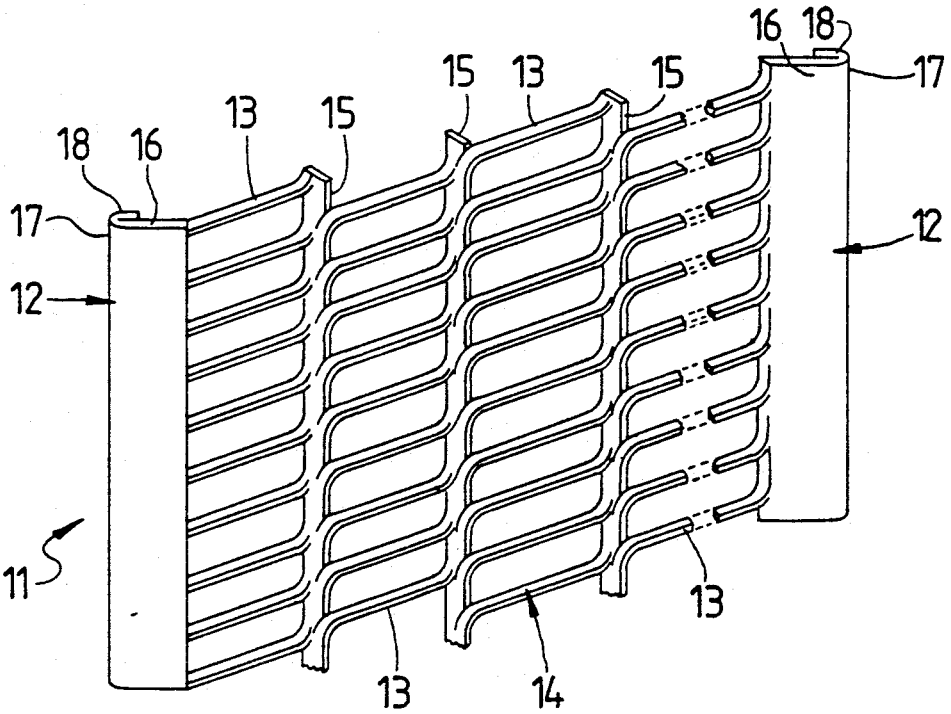
FIG. 1 is perspective view of our improved lath panel.
Figure 4:
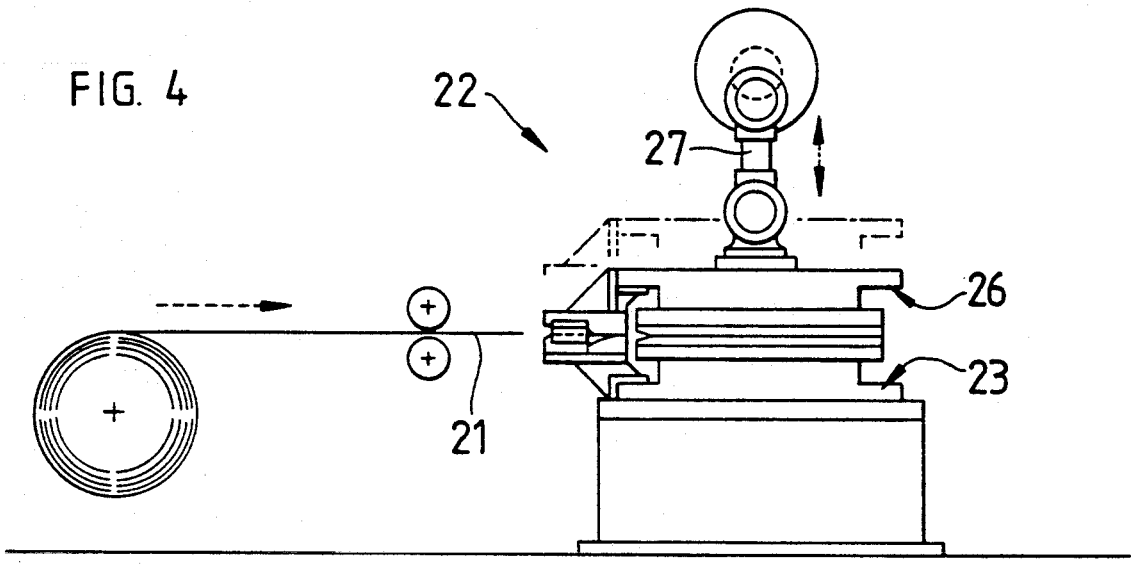
FIG. 4 is an elevational view of a typical punch press fitted with tooling for manufacture of our improved lath panel.
Figure 5:
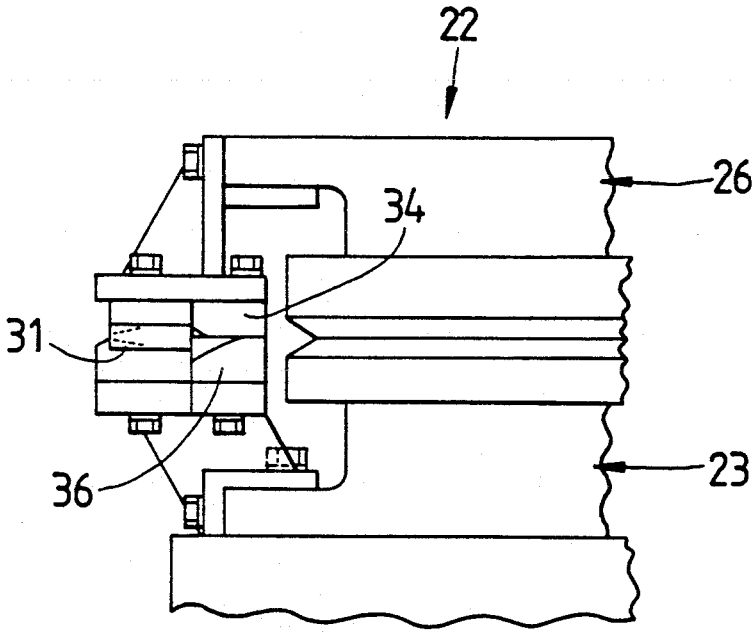
FIG. 5 is an enlarged elevational view of the hemming tooling in situ.

Referring to the drawings for a clearer understanding of the invention, it is shown in FIGS. 1-3 that the present invention contemplates a lath panel 11 having a pair of parallel marginal ribs 12 and a plurality of interconnected strands 13 connected intermediate the marginal ribs 12 which form a substantially planar sheet of mesh 14.

As shown in FIGS. 1-3, each marginal rib 12 is folded about a longitudinal axis to form a pair of layers 18 which include an upper portion 16 integrally connected to a margin of the mesh 14, a rounded outer edge 17 partially formed by the upper portion 16 and a lower portion 18 connected to and partially forming the rounded outer edge 17 and extending in subjacent parallel planar abutment with the upper portion 16. Each marginal rib 12 coextends a lateral edge of the sheet of mesh 14 and extends laterally therefrom such that the rounded outer edge 17 forms a margin of the lath panel 11.

Inner ribs 15 are integrally connected intermediate the strands 13 in parallel relation to the marginal ribs 12. Each strand 13 is integrally connected either intermediate a marginal rib 12 and an inner rib 15 or intermediate two inner ribs 15, each strand being serpentine in shape and having a plurality of upper curves 15*a* and lower curves 15*b*. The strands 13, the inner ribs 15, and the marginal ribs 12 are constructed in integrally connected relation from a single blank panel 21 of pliable metal, preferably galvanized steel or aluminum but not limited thereto.

Figure 6:
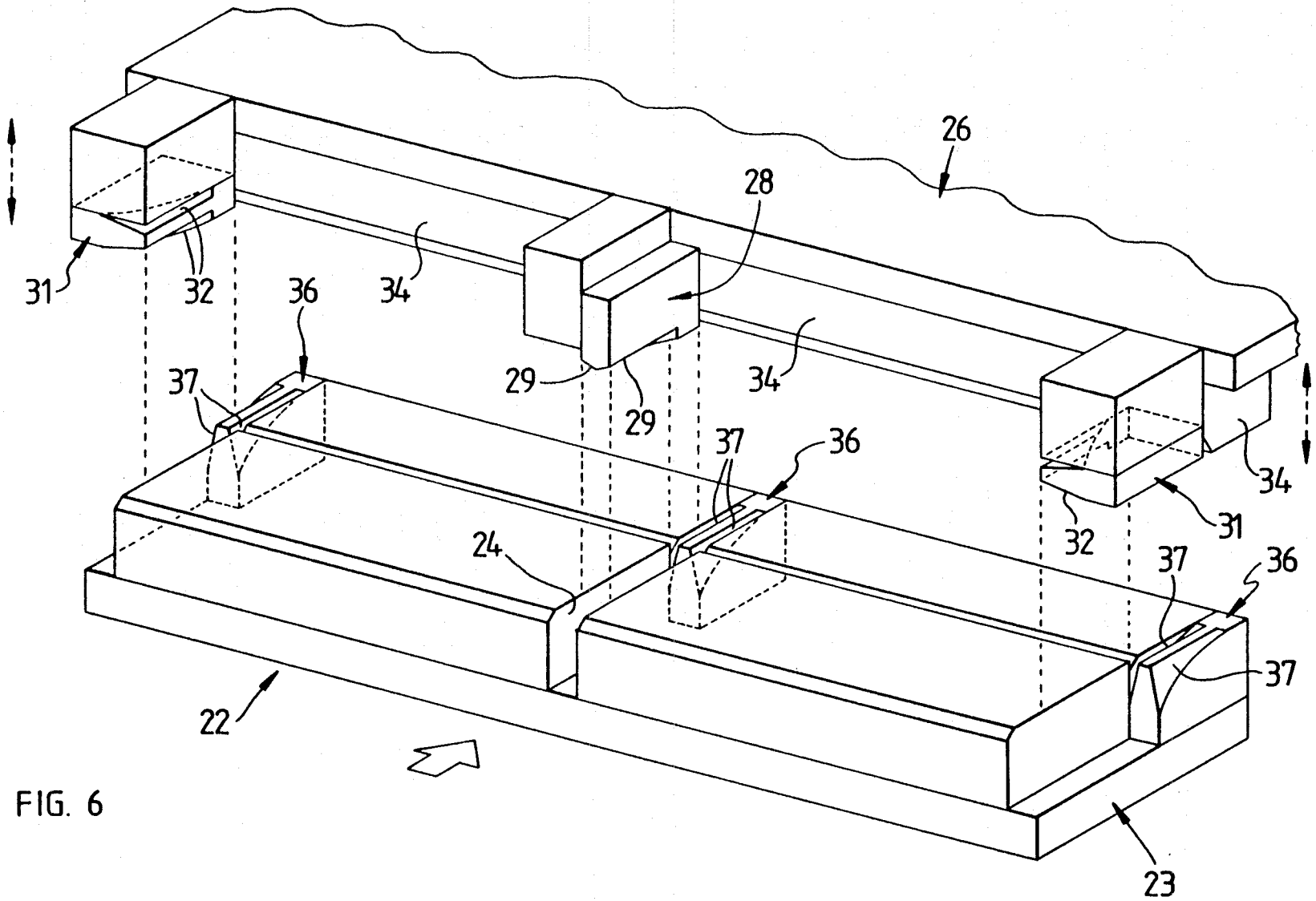
FIG. 6 is a perspective view of the rib forming tooling assembled.
Figure 7:
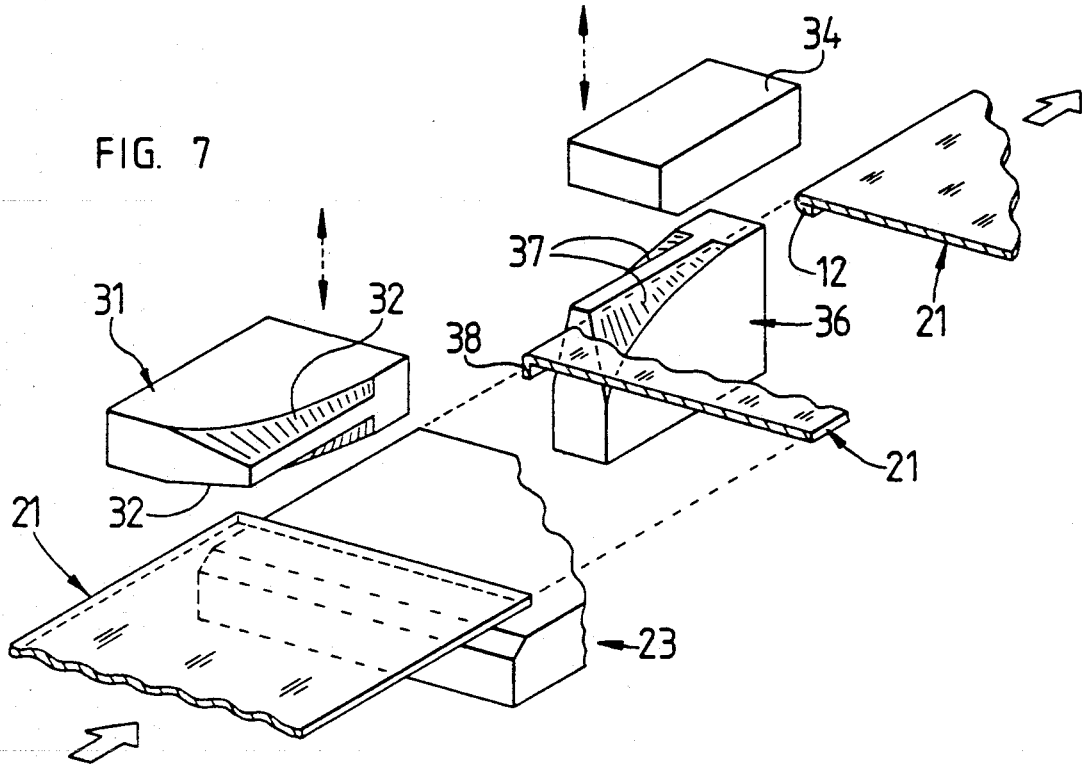
FIG. 7 a perspective view of the sequence of singular edge forming.
Figure 8:
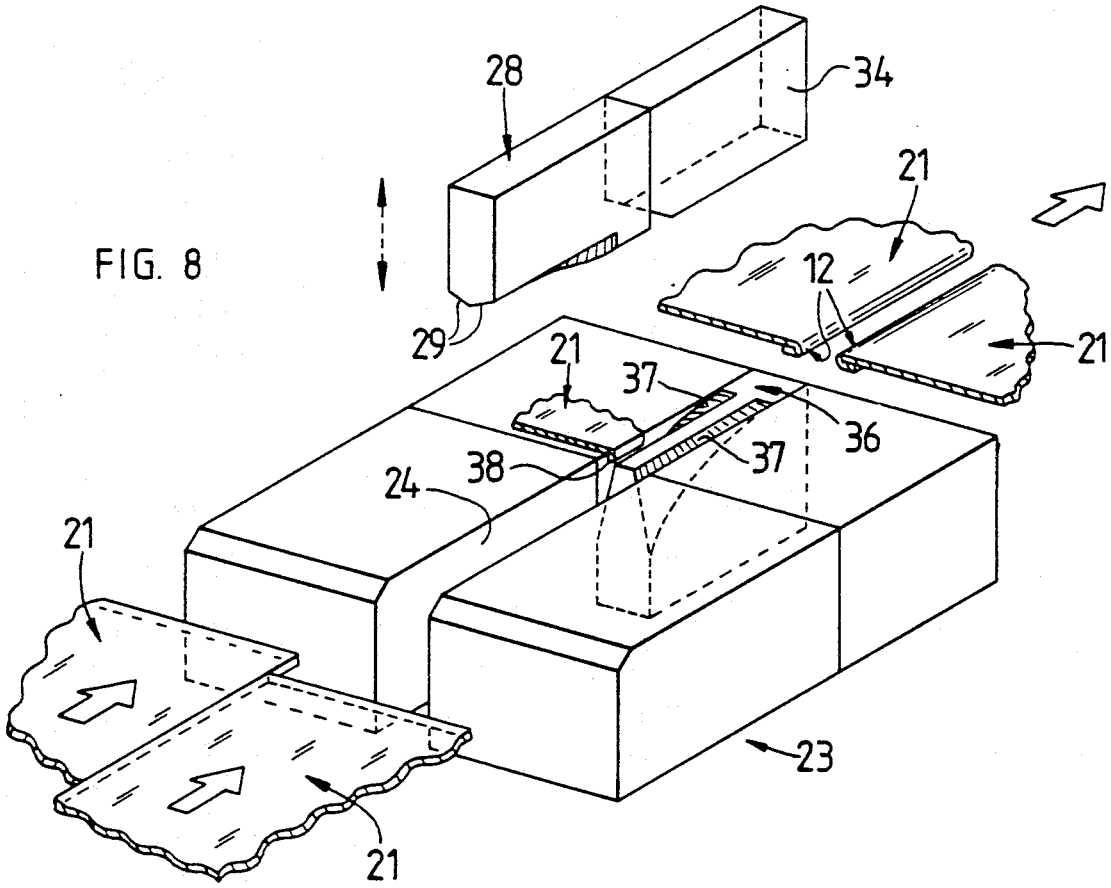
FIG. 8 is a perspective view of the sequence of multiple edge forming.

As shown in FIGS. 4–7, the lath panel 11 is constructed with the aid of a reciprocating punch press 22. As shown in FIGS. 6–8, the punch press 22 includes a bottom platen plate 23 having a plurality of openings 24 defined thereon which extend parallel the direction the blank panel 21 is fed into the punch press 22. The punch press includes a press platen plate 26 suspended above the bottom platen plate 23 from a reciprocating press arm 27. The press arm 27 is operatively mounted to a punch press frame (not shown) to vertically reciprocate the press platen plate 26 in close but not contacting proximity with the bottom platen plate 23.

Mounted to the press platen plate 26 above and parallel each channel 24 of the bottom platen plate 23 is one of a plurality of first forming tools 28. As shown in FIGS. 9–12, each first forming tool 28 is rectangular and includes two helical first forming surfaces 29 defined in diverging relation thereon. Each first forming surface has an increasingly steeper grade in the direction the blank panel 21 is conveyed. As shown in FIG. 6, the first forming surfaces 29 are positioned on the underside of the first forming tool 28 and on each downward stroke of the press arm 27, blank panel 21 is advanced a predetermined distance within the channels 24 located thereunder.

A pair of second forming tools 31 are each mounted to the press platen plate 26 just beyond a lateral edge of the bottom platen plate 23. As shown in FIGS. 13–16, the second forming tool 31 is rectangular and includes a pair of helical second forming surfaces 32 defined in spaced apart diverging relation thereon. As shown in FIG. 6, the second forming surfaces 32 are positioned on a lateral side of the second forming tool 31 and on each downstroke of the press arm 27, pass below the upper surface of the bottom platen plate 23 in proximity with the lateral edges thereof. The second forming tool 31 is mounted to the press platen plate 26 with one second forming surface 32 facing downwardly. The downwardly facing second camming surface 32 has an increasingly steeper grade in the direction that the blank panel 21 is conveyed. A hammer block 34 is mounted to the press platen plate 26 just behind the first and second forming tools and on each downward stroke of the press, arm 27 contacts the upper surface of the bottom platen plate 23. A plurality of third forming tools 36 are mounted below the hammer block 34 within each channel 24 and on each lateral edge of said bottom platen plate 23 just below the upper surface thereof, each having two helical third forming surfaces 37 which partially define the upper face thereof and diverge in lateral relation to the longitudinal axis thereof. The third forming tool 36 is shaped similarly to the second forming tool 31 differing only in its orientation and placement on the punch press 22. The third forming surfaces 37, when mounted in the channels 24 as previously described have an increasingly shallow grade in the direction the blank panel is conveyed.

The method for constructing the lath panel 11 includes introducing the blank panel 21 into the punch press 22 in intermittent feed strokes. As shown in FIG. 6, the blank panel 21 is conveyed across the bottom platen plate 23 parallel the longitudinal extension of the channels 24 with each lateral edge of the blank panel 21 being extended a predetermined distance across one of the channels 24 or an equal distance beyond the lateral edge of the bottom platen plate 23.

On each upward stroke of the press arm 27, the blank panel 21 is conveyed one feed stroke of predetermined length across the bottom platen plate 23. Eventually, each edge of the blank panel 21 is conveyed beneath either a first or a second forming tool 31, whereupon the forward corners of the blank panel 21 are bent downwardly and laterally inward by the downwardly descending first or second forming surfaces 29 and 32. As the blank panel 21 is progressively fed forward, the lateral edges of the panel 21 are repeatedly subjected to the blows of the first or second forming surfaces 29 and 32 which eventually bend the edges in substantially perpendicular relation to the horizontal plane in which said blank panel 21 is included, thereby forming a pair of lateral legs 38 as shown in FIG. 7. The legs 38 pass from beneath the first and second forming tools 28 and 31 across one of the plurality of third forming surfaces 37 and on each feed stroke are subjected to an impact from the downwardly descending hammer block 34 which in cooperation with the helical surface of the third forming surface 37 folds the legs 38 inward and upward in planar abutment with the blank panel 21 thereby forming the marginal ribs 12. The helical shape of the first, second and third forming surfaces facilitates a gradual, continuous bending of the blank panel 21 thereby forming smooth rounded marginal ribs 12 free of noticeable imperfections.

It is a common practice in the art to lance the blank panel 21, thereby defining a plurality of parallel slits (not shown) and then expand the blank panel 21 to form a mesh 14. By leaving gaps between preselected slits, the inner ribs 15 are formed as the blank panel 21 is expanded. Lancing is customarily facilitated with a punch press; consequently, the cutting tool (not shown) necessary for lancing the blank panel 21 is mounted to the press platen plate 26 behind the hammer block 34 for lancing the blank panel 21 in progressive sequence with the forming of the marginal ribs 12. Once lanced, the blank panel 21 is expanded using methods common in the art thereby separating the strands 13 into the stair step configuration shown in FIGS. 1 and 2. When the lanced blank panel 21 is expanded, tension forces are applied to the marginal ribs 12 which angle the marginal ribs 12 in relation to the substantially planar configuration of the mesh 14. From the foregoing, it should be clear that the apparatus and method represent a substantial improvement over the prior art.

While we have shown our invention in one form, it will be obvious to those skilled in the art that it is not so limited but is susceptible of various changes and modifications without departing from the spirit thereof.

What we claim is:

1. A reinforced lath panel having a mesh on which plaster or other plastics having a high viscosity can be supported in a structural unit comprising:

(a) at least one elongated marginal rib connected to said mesh along one edge thereof and, having a plurality of integrally connected parallel and abutting layers, wherein each said marginal rib is folded about a longitudinal axis to form a rounded outer edge which defines a lateral margin of said lath panel; and (b) a plurality of integrally connected strands connected to said marginal rib, wherein said layered marginal rib is substantially more rigid than said strands.

2. A lath panel as described in claim 1 wherein said marginal ribs are parallel to each other.

3. A lath panel as described in claim 2 further comprising a plurality of inner ribs mounted to said strands in parallel relation to said marginal ribs wherein said marginal ribs are substantially more rigid than said inner ribs.

4. A lath path for securing plaster to a smooth surface comprising:

(a) a substantially planar sheet of metal mesh; and (b) a plurality of elongated reinforced marginal ribs each integrally connected to said mesh and having a plurality of integrally connected parallel and abutting layers, wherein each said marginal rib is folded about a longitudinal axis to form a rounded outer edge which defines a lateral margin of said lath panel.

5. A lath panel as described in claim 4 wherein said marginal ribs are parallel to each other.

6. An improvement in lath panels which have a mesh composed of a plurality of integrally connected strands onto which plaster or other plastics having a high viscosity can be supported in a structural unit, the improvement comprising at least one marginal rib integrally connected along one side of said mesh and having a plurality of integrally connected layers providing substantially increased rigidly to said mesh than said plurality of strands, said plurality of integrally connected layers forming a rounded outer longitudinal edge on said rib with one of said plurality of layers underlapping and abutting in substantially parallel relationship another of said plurality of layers.

* * * * *